United States Patent [19]

Digate

[11] 4,185,402

[45] Jan. 29, 1980

[54] DEODORIZING INSOLE

[75] Inventor: James S. Digate, Chicago, Ill.

[73] Assignee: Scholl, Inc., Chicago, Ill.

[21] Appl. No.: 847,918

[22] Filed: Nov. 2, 1977

[51] Int. Cl.[2] ..... A43B 13/38

[52] U.S. Cl. ..... 36/44; 36/3 B

[58] Field of Search ..... 36/44.43, 3 B

[56] References Cited

U.S. PATENT DOCUMENTS

| | | | |
|---|---|---|---|
| 1,926,283 | 9/1933 | Herbert | 36/44 |
| 2,061,911 | 11/1936 | Leindorf | 36/43 |
| 2,451,929 | 10/1948 | Dorgin | 36/44 |
| 3,418,731 | 12/1968 | Anciaux | 36/3 B |
| 3,842,519 | 10/1974 | Lapidus | 36/44 |
| 3,852,897 | 12/1974 | Bridge et al. | 36/44 |
| 4,062,131 | 12/1977 | Hsiung | 36/44 |

FOREIGN PATENT DOCUMENTS

| | | | |
|---|---|---|---|
| 2310100 | 5/1975 | France | 36/3 B |
| 728075 | 4/1955 | United Kingdom | 36/44 |
| 794938 | 5/1958 | United Kingdom | 36/3 B |
| 1270809 | 4/1972 | United Kingdom | 36/44 |

*Primary Examiner*—James Kee Chi

*Attorney, Agent, or Firm*—Hill, Van Santen, Steadman, Chiara & Simpson

[57] ABSTRACT

An odor and moisture absorbing insole or insock for covering the inner sole of footwear has a bottom open cell latex foam layer with a smooth bottom skin for engaging the bottom inner sole of footwear, an intermediate noncellular latex layer with discrete activated charcoal particles dispersed throughout and locked in this layer, a porous slippery abrasion resisting top fabric layer protecting the foot or sock of the wearer against discoloration or irritation, and spaced perforations extending through the three layers to enhance the circulation of air toward and away from the foot of the wearer into intimate contact with the charcoal in the intermediate layer as the open cell bottom foam layer is alternately compressed and expanded upon application and release of foot pressure on the insole as when walking. The open cell bottom layer and the top fabric layer are free from charcoal, and discoloration of the footwear, foot or sock is eliminated by bonding the charcoal particles in the intermediate layer. The intermediate latex layer containing the activated charcoal is deposited in viscous slurry form on top of the nonslippery face of the fabric, doctored to a controlled thickness, a viscous foam forming latex mix is deposited on top of the doctored slurry and in turn is doctored to a controlled thickness providing a smooth top surface, and the three layer assembly is heated to set and foam the top layer, and to set the intermediate layer in bonded relation with the fabric layer and the foam layer. The thus formed three-layer laminated sheet is punched to form a myriad of holes therethrough and is trimmed to insole shape. The process may be continuous with the fabric being unwound from a roll, advanced under latex feeders and under the adjacent doctors and then fed continuously through a drying oven to emerge as a laminated sheet which is easily rolled and transported to perforation forming punches and insole shaping cutters.

10 Claims, 9 Drawing Figures

DEODORIZING INSOLE

RELATED APPLICATION

This application is related to the Du Yung Hsiung U.S. Application Ser. No. 722,127, filed Sept. 10, 1976 (now U.S. Pat. No. 4,062,131 issued Dec. 13, 1977) entitled "Insole For Footwear" assigned to Scholl, Inc., a corporation of New York with offices in Chicago, Ill., and also the assignee of this application.

FIELD OF THE INVENTION

This invention deals with the art of comfortable footwear insoles which absorb moisture and destroy odors caused by foot perspiration and poor ventilation of the footwear. Specifically, the invention provides a multilaminar insole having an open cell resilient plastics layer, a fabric top layer and an intermediate layer containing an odor-absorbing chemical as disclosed and claimed in the aforesaid related application, but having the chemical locked in a relatively dense and relatively incompressible intermediate layer formed from a slurry of plastics material and the odor destroying chemical and having a myriad of holes extending through all of the layers to increase air circulation.

SUMMARY OF THIS INVENTION

The disclosure of the aforesaid related application is incorporated herein by reference and this invention is distinguished from the incorporated disclosure by dispersing the odor destroying chemical, preferably activated charcoal, in a plastics material slurry, preferably latex, to form a discrete intermediate layer with the chemical locked therein and heat bonded to the top fabric layer and the bottom open cell foam layer and the provision of a myriad of perforations through all three layers to increase air circulation. In the related application, the intermediate layer is composed of nonwoven discrete fibers coated with the odor-absorbing chemical, the layers are joined by air pervious bonds and no perforations or holes are provided through the three layers.

According to this present invention, the three layers of the insole are integrally united without added bonding agents and the bonds are formed by successive depositions of viscous slurries of different plastics material on a top fabric layer followed by heating the assembly to cure and set the plastics materials. The plastics material forming the intermediate layer is dense, relatively nonporous and relatively incompressible so as to hold particles of the odor-absorbing chemical in locked spaced relation to expose the surface of the particles at the interfaces with the fabric and foam and at the peripheries of the holes or perforations without allowing migration or breaking away of the particles during use. The dense intermediate layer gives "body" to the insole to resist stretching or twisting but is sufficiently pliable to permit the insole to conform with the footwear and foot of the wearer.

The top fabric and the bottom foam layers are free from particles of the odor-absorbing chemicals and protect the footwear and the wearer against staining by migration of the particles through the fabric and the foam. The odor-absorbing particles are discrete providing extensive surface areas and are locked or securely anchored in the intermediate layer. Since this intermediate layer is relatively incompressible, these particles are not pumped from the layer. Activated charcoal particles of about 200 mesh size are the preferred odor-absorbing chemical. Other particulate chemicals such as silica gel, diatomaceous earth and the like odor absorbents can be used.

The chemical particle carrying intermediate layer is preferably composed of a styrene-butadiene carboxylated latex containing 15–30% by weight of the chemical particles, but other plastics materials forming a dense relatively incompressible body layer could be used.

The top fabric layer is preferably a tackle twill woven cotton and acetate fiber sheet but other woven and nonwoven fabrics providing a slippery top face can be used, such as cotton scrim, nylon and the like.

The bottom open cell layer is preferably a rubber latex foam but other resilient open cell plastics material foams such as polystyrene, polyurethane, vinyl chloride plastisol and the like foams are useful.

It is then an object of this invention to provide a laminar odor and moisture absorbing insole for footwear having a particulate odor and moisture absorbing chemical dispersed and locked in an intermediate layer where it cannot discolor the footwear or the foot or sock and having the chemical particles exposed for intimate contact with air circulating through the insole.

Another object of this invention is to provide an insole having a top fabric layer, an intermediate dense, impervious, relatively incompressible plastics layer with activated charcoal uniformly dispersed in discrete particle form throughout the layer, and an open cell resilient, compressible foam bottom layer for pumping air through holes in the intermediate layer in intimate contact with the activated charcoal.

Another object of this invention is to provide an insole having a top fabric layer with a plurality of underlying latex layers at least one of which has discrete odor-absorbing chemical particles dispersed uniformly throughout the entire layer and locked in the layer to prevent migration to the fabric layer.

A specific object of the invention is to provide a perforated three-layer insole with activated charcoal particles of extensive surface area discretely dispersed throughout and locked in an intermediate layer.

Other and further objects of this invention will become apparent to those skilled in this art from the following description of the annexed sheets of drawings which, by way of a preferred example only, illustrate one embodiment of the invention.

ON THE DRAWINGS

AS SHOWN ON THE DRAWINGS

Figure 1:
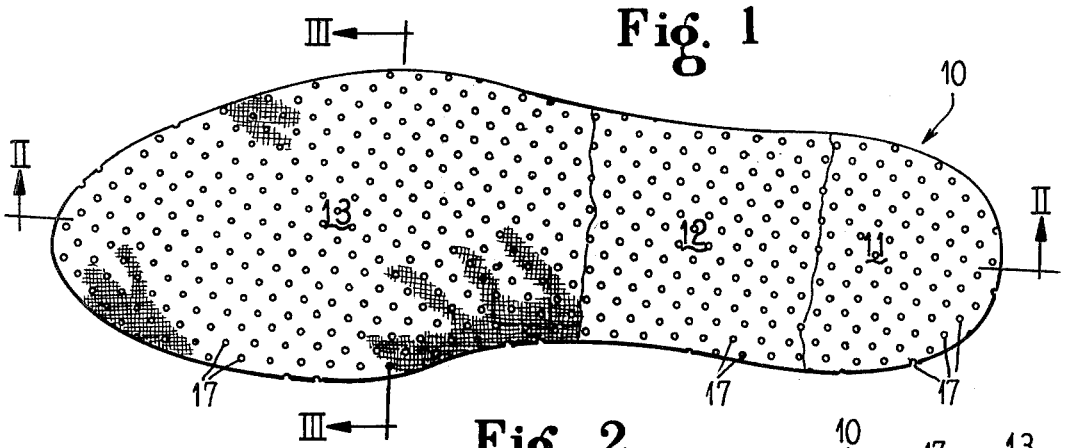
FIG. 1 is a top plan view, with parts broken away to show underlying layers of an odor and moisture absorbing shoe insole according to this invention.
Figure 2:
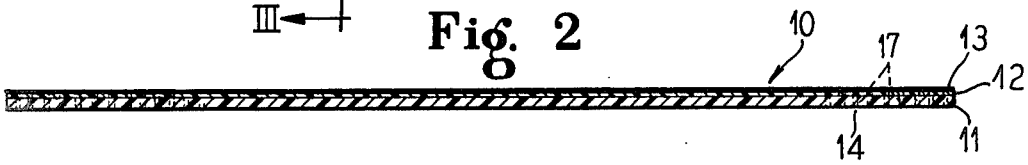
FIG. 2 is a longitudinal cross-sectional view taken along the line II—II of FIG. 1.
Figure 3:
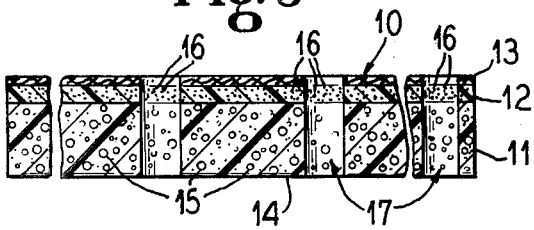
FIG. 3 is a transverse cross-sectional view taken along the line III—III of FIG. 1 but with the thickness of the layers greatly enlarged for clarity.

The reference numeral 10 of FIGS. 1 through 4 illustrates a shoe insole according to this invention composed of an open cellular foam resilient compressible plastics material layer 11, an intermediate thinner relatively incompressible plastics layer 12 and a top fabric layer 13, all integrally bonded to form a unitary three-layer laminate.

The bottom layer 11 is an open cell plastics foam sheet with a bottom skin 14 presenting a smooth bottom surface which may be less porous than the main body of the sheet. The bottom layer sheet has a myriad of open pores or cells 15 dispersed uniformly throughout the body. The sheet is resilient and preferably has a free state thickness of from 0.2 to 0.4 inches. A conventional elastomeric plastic foam mix, such as a rubber latex, polyurethane, and the like is useful. Formula F7653 furnished by Coated Fabrics, Inc. of Dalton, Ga. is satisfactory as is "Foamcote" furnished by Crown Products Corporation of St. Louis, Mo.

The intermediate plastics layer 12 has a thickness of about 0.07 to 0.12 inches, is pliable but relatively incompressible and impervious, and may be formed from a carboxylated sytrene-butadiene latex of the type supplied by Goodyear Tire & Rubber Company of Akron, Ohio, Firestone Tire & Rubber Company of Akron, Ohio, and Coated Fabrics, Inc. of Dalton, Ga. Coated fabrics formula C-7653 is a preferred latex. This layer 12 has discrete particles of activated charcoal 16, such as Union Carbide Corporation, New York, N.Y., Grade JXC-200. This grade activated charcoal is 200 mesh size and the particles have an extensive surface area. The particles illustrated at 16 are dispersed uniformly throughout the layer 12 and are integrally locked and bonded in the layer as discrete particles exposing their extensive surface areas.

A suitable slurry mix for the intermediate layer 12 is:

1. Styrene-butadiene carboxylated latex—63–85% by weight;
2. Activated charcoal—200 mesh particles—15–30% by weight;
3. Trisodium polyphosphate wetting agent—0–5% by weight;
4. Sodium polyacrylate thickener—0–2% by weight.

The thickener is added in sufficient quantity to adjust the viscosity of the slurry between about 3,000 to 5,000 cps.

The layers 11 and 12 are cured and bonded to each other and to the fabric layer 13 by heating to temperatures of about 300° F. with a dwell time depending on the thickness of the layers and whether or not the layers are cured separately or simultaneously as hereinafter described.

The insole has a myriad of small diameter holes 17 extending vertically through all three layers thereof. These holes preferably have a diameter of 0.054±0.003 inches and are preferably spaced about 0.310±0.01 inches. As shown the holes 17 are in aligned rows with the holes of adjacent rows being offset halfway between the spacings. Thus, the holes in one row would be offset 0.155 inches from the holes in the adjacent row.

Figure 5:
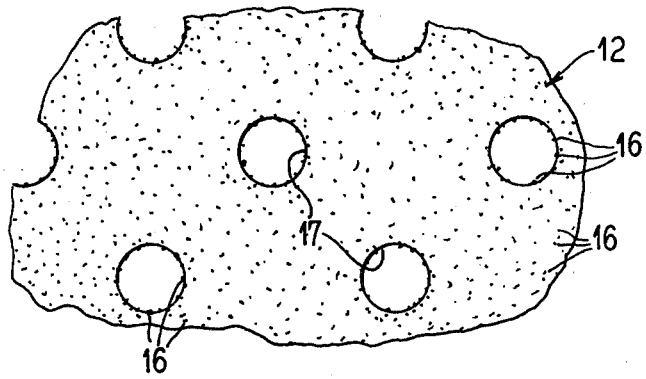
FIG. 5 is a greatly enlarged plan view of the intermediate layer of the insole.

This myriad of holes 17 provides for enhanced circulation of air through the insole as the foam layer of the insole is compressed and expanded as when the weight of the foot is alternately applied and released from the insole when walking. As shown, the holes expose the particles 16 of activated charcoal in the intermediate layer 12 and, in addition, this intermediate layer has the particles 16 exposed on its top face as shown in FIG. 5. The charcoal particles 16 are similarly exposed on the bottom face of the layer. However, all the particles 16 including the exposed particles are securely locked or bonded in the plastics material forming the layer 12.

Figure 4:
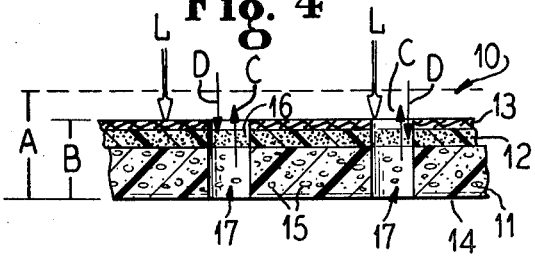
FIG. 4 is a view similar to FIG. 3 but showing the condition of the layers under foot pressure.

When foot loads L are applied to the insole 10 as shown in FIG. 4, the thickness of the insole may be reduced from A to B by reduction in the thickness of the bottom foam layer 11 which is compressed to about half of its free state thickness. The layers 12 and 13 are not appreciably compressed, and the holes 17 are not closed. Air in the pores 15 of the layer 11 is squeezed as the layer is flattened to flow, as shown by the arrows C, through the fully open holes 17 into intimate contact with the activated charcoal particles 16. Then when the loads L are released, the insole will expand from its B to its A thickness and the air and vapors from the foot area will be drawn back through the holes as shown by the arrows D. This creates a pumping action, circulating air in both directions through the insole and exposing the air to the extensive surface areas of the activated charcoal particles 16 for absorption of foot perspiration and neutralization of foot odor bacteria.

The insole of this invention may be conveniently produced as illustrated in the diagrams of FIGS. 6 through 9.

Figure 6:
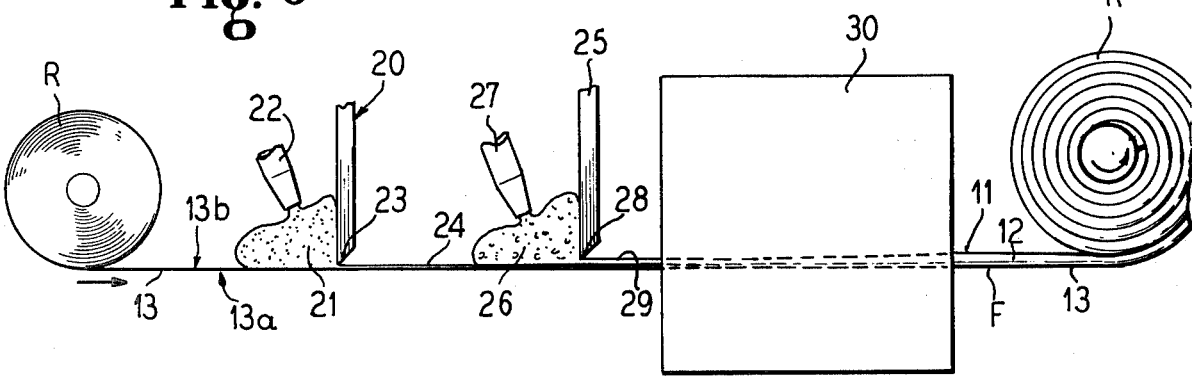
FIG. 6 is a somewhat diagrammatic elevational view showing a method of producing the insoles of this invention.

As shown in FIG. 6, a roll R of fabric such as tackle twill 13 is unwound with the smooth face side **13*a* of the fabric facing downward and the rougher face 13*b* of the fabric forming a top horizontal face. The fabric is fed horizontally under a first doctor blade 20 and a pond 21 of the activated charcoal containing styrene-butadiene carboxylated latex slurry described hereinabove. The pond is fed from a supply pipe 22 to maintain a depth above the bottom edge 23 of the doctor blade 20 so that a layer 24 of controlled height is deposited on the fabric 13 emerging from under the doctor blade 20. As pointed out above, this layer 24 is controlled to a depth of from 0.02 to 0.04 inches. The slurry is sufficiently thick so that it will not run off of the fabric, and it is then passed under a second doctor 25 and a pond 26 fed from a supply pipe 27 composed of the foam latex mix described hereinabove. The bottom edge 28 of the second doctor 25 is spaced so that a layer 29** of sufficient thickness to form a foamed sheet of from 0.11 to 0.14 inches thick is formed. A preferred combined thickness for these two layers is 0.13 inches.

The double coated fabric twill 13 is then fed through an oven 30 heated to temperatures of about 300° F. to foam the layer 29 and to cure both layers for forming the finished foam layer 11 and intermediate layer 12 of the insole. The dwell time in the oven 30 is about 15 to 20 minutes. The coated fabric F with the cured layers thereon is then rolled into a roll R'.

Figure 7:
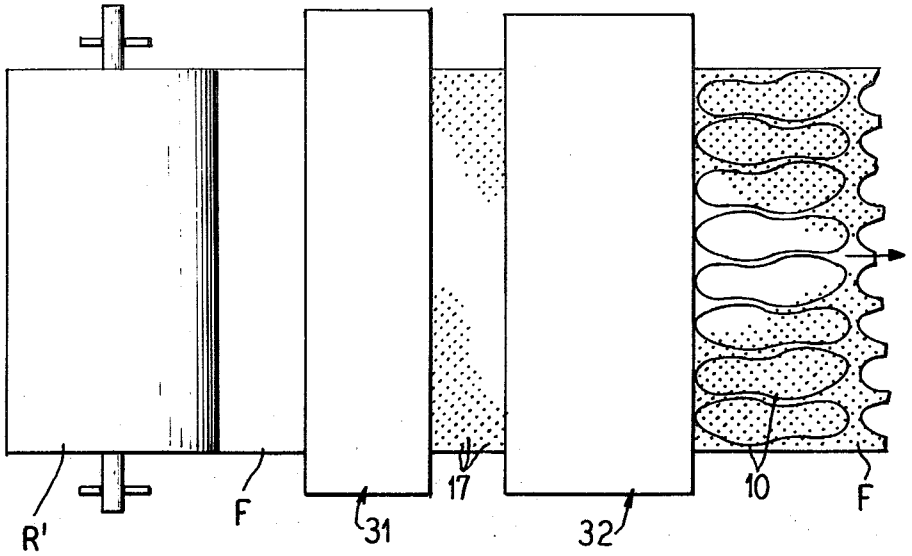
FIG. 7 is a fragmentary diagrammatic plan view illustrating the punching and cutting of the laminated sheet formed as shown in FIG. 6.

As shown in FIG. 7, the double coated fabric roll R' sheet 17 is unwound to pass the double coated fabric F through a punching apparatus 31 forming the myriad of holes 17 and then through a cutting machine 32 to cut out the insoles 10 from the perforated sheet.

Figure 8:
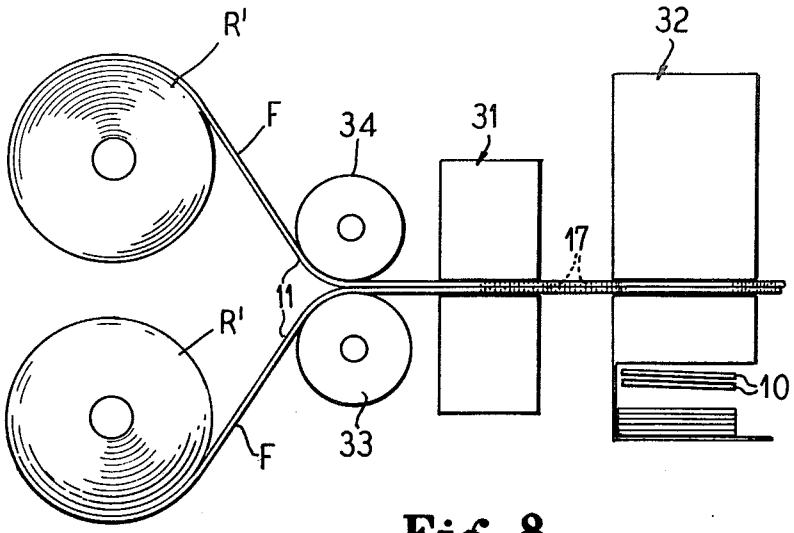
FIG. 8 is a side elevational, diagrammatic view illustrating the manner in which a plurality of laminated sheets produced as shown in FIG. 6, can be superimposed and simultaneously punched and cut to form mating pairs of insoles.

If desired, as shown in FIG. 8, two rolls R' of the coated sheet fabric F can be unwound and brought together by guide rolls 33 and 34 with their foam latex layers 11 in face to face engagement. The two ply stack of coated fabric sheets F is then fed through the punch apparatus 31 to form the holes 17 and the cutting apparatus 32 to form the insoles 10 in stacked pairs with each pair providing insoles for the right and left foot.

Figure 9:
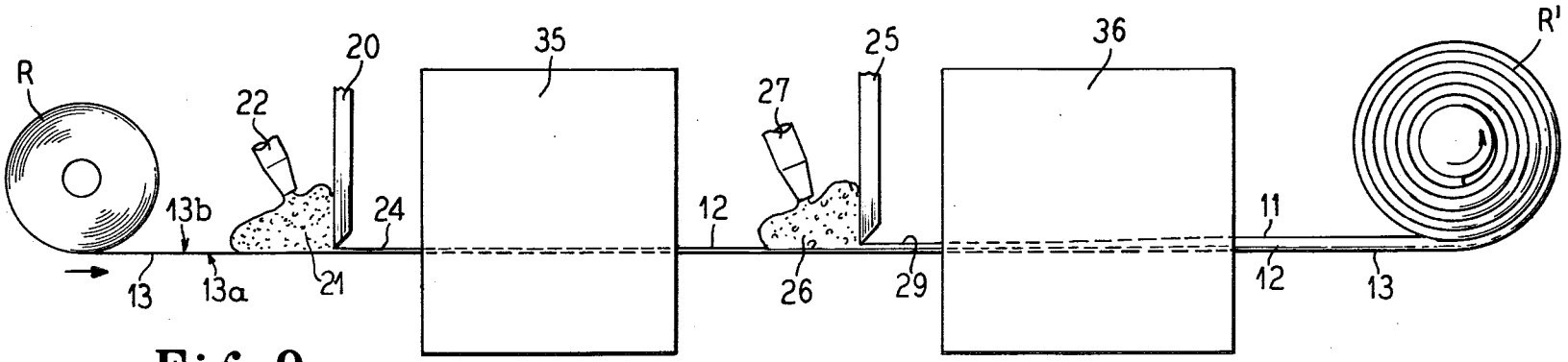
FIG. 9 is a view similar to FIG. 6 but showing an alternate method of forming the laminated sheet according to this invention.

Alternately, the roll R of twill fabric 13 can be unwound as shown in FIG. 9 with its rough face **13*b* uppermost and passed under the pond 21 and doctor 20 to form the activated charcoal-latex layer 24. The single coated fabric is then passed through a first curing oven 35 heated to curing temperatures of about 300° F. for a dwell time of about 3 to 4 minutes. The single coated fabric then emerges from the oven 35 with its cured layer 12 and passes under the pond 26 and the second doctor blade 25 to receive the second coating layer 29 of foam latex on top of the cured layer 12. The double coated fabric is then passed through a second oven 36 where the top layer 29 is foamed and cured to form the open cell latex layer 11. The dwell time in the oven 36 is about 8 to 10 minutes and the emerging double coated and cured fabric is then rolled into the roll R' for treatment as in FIGS. 7 and 8**.

It will be noted that no additional adhesives or bonding agents are needed to integrally unite the three layers since the slurry forming the first layer 24 becomes integrally bonded to the fabric layer when it is cured and the second layer 29 becomes integrally bonded with the intermediate layer when it is cured. The passage of the foam layer under the second doctor 25 smoothes the top face of this layer to form the skin 14 of the foam layer 11.

The charcoal particles 16 are integrally bonded in the plastics material of the intermediate layer 12 and cannot migrate from this layer into the bottom foam layer or the top fabric layer. The particles,. however, are exposed to the fabric layer 13 at the top surface of the layer 12 and in the myriad of holes 17. The footwear and the foot of the user is thus protected against any discoloration or irritation from the odor-absorbing chemical but air circulates over the extensive areas of the particles 16 at the fabric 13—layer 12 interface, at the layer 12—layer 11 interface and in the myriad of holes 17.

The latex foam formulation of the bottom layer 11 is moisture absorbing and adds to the moisture and odor-absorbing capacity of the activated charcoal to enhance the overall moisture-absorbing capacity of the insole.

From the above descriptions, it will be appreciated that this invention provides an improved shoe insole with odor neutralizing chemicals locked in an intermediate layer of a multilayer laminated flexible and resilient insole having air circulating holes therethrough sized and arranged to intimately expose the odor-absorbing chemical with air that is pumped through the insole when pressure is applied to and released therefrom as in walking. It will, of course, be appreciated that the preferred formulations, relative dimensions, and the like, may be widely varied without departing from the principles of this invention.

I claim as my invention:

1. An insole for footwear which comprises a multi-sheet laminate shaped to overlie the inner sole of footwear and composed of a bottom open cell resilient compressible plastics sheet with a smooth bottom skin for resting on the inner sole of the footwear, an intermediate pliable relatively incompressible plastics sheet having particles of an odor-absorbing chemical dispersed uniformly therethrough and locked therein, a top fabric sheet presenting a slippery abrasion resisting top surface for the foot of the wearer, said sheets being bonded together in unitary relation, and holes extending through all of the layers thereof exposing the chemical particles in the intermediate layer, said open cell resilient bottom layer being compressible under the foot load applied thereto to pump air from the cells through the holes in intimate contact with the chemical to absorb odors and moisture, and said holes being sufficiently large so as not to be closed during the compression of the bottom layer.

2. A moisture and odor-absorbing cushion insole for footwear comprising a multi-sheet pliable laminate shaped to cover the inner sole of a shoe and to receive the foot or sock of the wearer of the shoe, said laminate having a relatively thick bottom open cell resilient foam compressible plastics material layer with a smooth non-porous bottom skin, an intermediate impervious relatively incompressible pliable plastics sheet layer having activated charcoal particles dispersed uniformly therethrough and anchored therein and a top fabric layer, said foam and intermediate layers being formed in situ on said top fabric layer and heat bonded together and to said top fabric layer in unitary relation, a myriad of small diameter holes extending perpendicularly through all of the layers, said activated charcoal particles being exposed to the peripheral walls of said holes and to the interfaces of the intermediate layer with the open cell and fabric layers to absorb moisture and odors in air passing through the holes as the open cell layer is alternately compressed and expanded to pump air from and into the cells under application and release of load from the foot of the wearer as in walking.

3. The insole of claim 1 wherein the open cell resilient compressible plastics sheet is composed of foam latex.

4. The insole of claim 1 wherein the intermediate pliable sheet is composed of a styrene-butadiene latex.

5. The insole of claim 1 wherein the top fabric sheet is composed of woven twill.

6. The insole of claim 1 wherein the intermediate layer contains from 15–30% by weight of activated charcoal.

7. The insole of claim 1 wherein the odor-absorbing chemical is activated charcoal of about 200 mesh size.

8. The insole of claim 1 wherein the holes having a diameter of about 0.05 to 0.057.

9. The insole of claim 8 wherein the holes are spaced about 0.3 inches.

10. The insole of claim 9 wherein the holes are arranged in aligned rows with holes of adjacent rows being offset halfway between the spacings.

* * * * *